United States Patent [19]

Anderson et al.

[11] 4,006,546

[45] Feb. 8, 1977

[54] BACK-LIGHTED DISPLAY ARRANGEMENT

[75] Inventors: Richard W. Anderson, Reading; Frederick F. Bodenrader, Georgetown, both of Mass.

[73] Assignee: GTE Sylvania Incorporated, Stamford, Conn.

[22] Filed: May 19, 1976

[21] Appl. No.: 688,058

[52] U.S. Cl. ..... 40/132 D

[51] Int. Cl.[2] ..... G09F 13/00

[58] Field of Search ..... 40/132 R, 132 D, 132 E, 40/130 E

[56] References Cited

UNITED STATES PATENTS

| | | | |
|---|---|---|---|
| 655,264 | 8/1900 | Nichol | 40/132 D X |
| 1,157,856 | 10/1915 | Eubank | 40/130 E X |
| 2,792,648 | 5/1957 | Coss | 40/132 D X |
| 3,194,954 | 7/1965 | Locke | 40/132 D X |
| 3,728,808 | 4/1973 | Rieth | 40/130 E |

*Primary Examiner*—Louis G. Mancene
*Assistant Examiner*—Wenceslao J. Contreras
*Attorney, Agent, or Firm*—Peter Xiarhos; Elmer J. Nealon; Norman J. O'Malley

[57] ABSTRACT

A back-lighted display arrangement including a soft, compressible opaque light baffle sandwiched between a lamp assembly and a display panel. The light baffle has a grid-like configuration defining a plurality of compartments each of which is arranged to receive a different one of a plurality of lamps supported by the lamp assembly and to direct light emitted by the lamp onto a different one of a plurality of display areas of the display panel. The light baffle establishes a positive light-tight seal between the baffle and the lamp assembly and display panel for preventing light in one compartment from escaping into an adjacent compartment.

5 Claims, 2 Drawing Figures

BACK-LIGHTED DISPLAY ARRANGEMENT

BACKGROUND OF THE INVENTION

The present invention relates to a back-lighted display arrangement and, more particularly, to a back-lighted display arrangement including a multi-compartment light baffle formed of a compressible material for preventing the escape of light from one compartment of the light baffle to an adjacent compartment.

Light baffles for use in back-lighted display arrangements are well known to those skilled in the art. These light baffles generally have a grid-like configuration defining a plurality of lamp compartments and are often constructed of a number of slotted strips of material (e.g., of "fish paper") interconnected together in a grid-like pattern to define the plurality of lamp compartments or, alternatively, of cast metal (e.g., aluminum) or plastic. Small lamps are physically disposed within the compartments of the light baffles and the light emitted by the lamps is used to back-light display areas (e.g., containing indicia) of display panels in abutment with the baffles. While the light baffles as described above function in a generally satisfactory manner, it is difficult, due to the rigid and unyielding nature of the light baffles, to obtain a tight physical seal and a positive light seal between the light baffles and the mating surfaces of the display panels and the lamp-carrying assemblies (e.g., printed circuit boards). As a result, it is possible for light in one compartment of a light baffle to leak around the edges of the compartment or otherwise escape into one or more adjacent compartments and to undesirably back-light the display areas associated with the adjacent compartments. The nature of the light baffles also requires that the mating surface of the baffles and the other elements of the assembly be flat, smooth and lack even minor surface irregularities (e.g., solder bumps or electrical leads on a printed circuit board on which the lamps are disposed). Otherwise, care must be taken in the designing of the baffles to avoid the surface irregularities. The light baffles as described above are also susceptible to vibration and of falling out of position or alignment with the display panels and/or the lamps.

BRIEF SUMMARY OF THE INVENTION

In accordance with the present invention, a back-lighted display arrangement is provided which includes a light baffle which overcomes the problems and disadvantages of prior art light baffles as described hereinabove. The back-lighted display arrangement in accordance with the invention includes a light source support member, a display means and the above-mentioned light baffle. The light source support member supports a plurality of light source means thereon, and the display means includes a plurality of display areas each of which is associated with a different one of the plurality of light source means and is arranged to be back-lighted by light emitted by the associated light source means. The light baffle in accordance with the invention is of a compressible material and is compressively sandwiched between the light source member and the display means and establishes a light seal between the baffle and the light source support member and display means. The compressed light baffle has portions defining a plurality of compartments each of which is arranged to receive a different one of the plurality of light source means whereby light emitted by the light source means is directed onto the display area associated with the light source means.

BRIEF DESCRIPTION OF THE DRAWING

Various objects, features and advantages of a back-lighted display arrangement in accordance with the present invention will be apparent from the following detailed discussion taken in conjunction with the accompanying drawing in which.

DETAILED DESCRIPTION OF THE INVENTION

Figure 1:
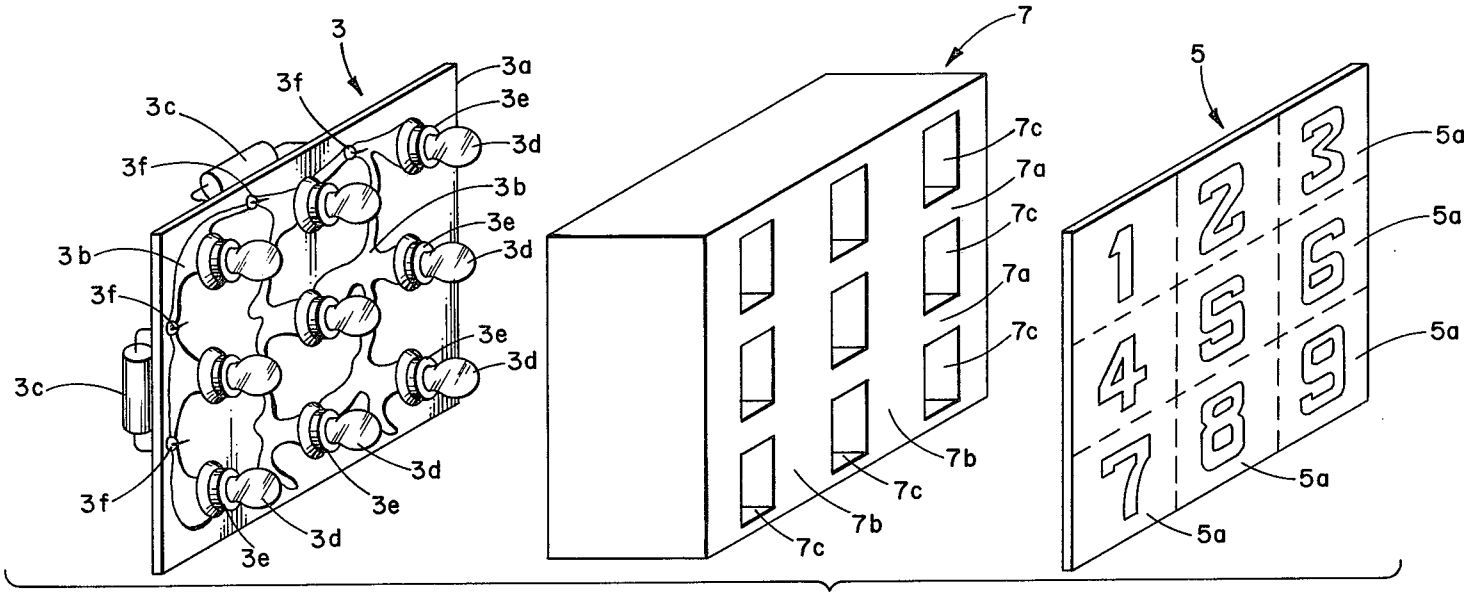
FIG. 1 is an exploded view in perspective of a back-lighted display arrangement in accordance with the present invention.
Figure 2:
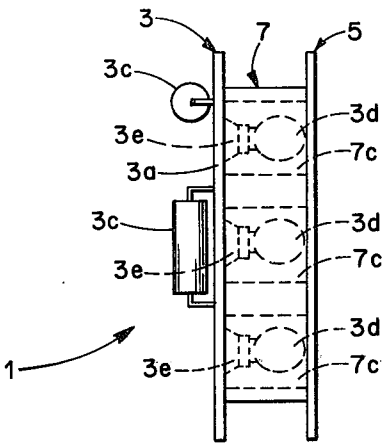
FIG. 2 is a side view of the back-lighted display arrangement of FIG. 1, in assembled form.

Referring now to FIGS. 1 and 2, there is shown, in exploded and side views, respectively, a back-lighted display arrangement 1 in accordance with the present invention. As shown in FIGS. 1 and 2, the display arrangement 1 generally includes a lamp assembly 3, a display panel 5, and a light baffle 7 intermediate to the lamp assembly 3 and the display panel 5. The lamp assembly 3 comprises a conventional printed circuit board 3*a* having standard etched copper conductors 3*b* and electrical components 3*c* thereon, and a plurality of small lamps 3*d* disposed in rows and columns within corresponding lamp sockets 3*e* secured to the printed circuit board 3*a*. As is common with printed circuit boards, the leads of the electrical components 3*c* extend through openings in the printed circuit board 3*a* and are soldered near their terminations by small mounds or lumps of solder 3*f*.

The display panel 5 as employed in the invention comprises a plurality of display areas 5*a* each of which may contain one or more indicia, as shown, for example, in FIG. 1, and each of which is associated with a different one of the lamps 3*d* of the lamp assembly 3. Each display area 5*a* is arranged to be illuminated, in a back-lighted fashion, by light emitted by its associated lamp. The display panel 5 may be of the "negative" type in which indicia represent clear, transparent portions of the panel 5 and the indicia are surrounded by dark non-light-transmitting portions. A suitable material for the display panel is plastic having a non-light transmitting coating thereon defining the aforementioned clear indicia. The display panel 5 as described above may also assume many other forms as are well understood by those skilled in the art.

The light baffle 7 as employed in the invention is physically sandwiched between the light assembly 3 and the display panel 5 and has horizontal and vertical portions 7*a* and 7*b*, respectively, interconnected in a grid-like fashion and defining a plurality of rows and columns of compartments or chambers 7*c*. Each of the compartments 7*c* is arranged to receive a different one of the lamps 3*d* for back-lighting a corresponding one of the display areas 5*a* of the display panel 5. A significant feature of the light baffle 7, and of the present invention, is that the baffle 7 is constructed of a compressible material. This characteristic of the light baffle 7 permits the baffle 7 to be compressed between the lamp assembly 3 and the display panel 5, and, as indicated in FIG. 2, to establish a tight, positive, light seal at the interface junctions of the baffle 7 and the lamp assembly 3 and display panel 5. Accordingly, light in one compartment 7*c* of the baffle 7 cannot escape to an adjacent compartment and illuminate the display area 5*a* associated with the adjacent compartment. An additional characteristic of the light baffle 7 in accordance with the invention is that it is soft which allows the baffle 7 to yield and conform to surface irregularities, such as the solder mounds 3*f* on the printed circuit board 3*a*, and also to be harmlessly pierced or penetrated by elements such as the leads of electrical components without impairment of the light seal established by the baffle 7 at its interface with the associated lamp assembly 3 and display panel 5. The baffle 7 is also able to readily absorb shocks or vibrations without falling out of alignment or moving out of position with respect to the lamps 3*d* and/or the display areas 5*a* of the display panel 5. Although the light baffle 7 can be constructed of a number of possible materials, a particularly suitable material is an opaque polyurethane cellular foam material such as formed by mixing together polyester resins and di-idocyanate. Such a foam material is sold by Durable Rubber Products Company, Chicago, Illinois. This material, in addition to being soft and compressible, is also flexible, light in weight, flame-resistant, electrically non-conductive, and can be easily worked (e.g., punched) and assembled together with the lamp assembly 3 and display panel 5 at low cost, even in small quantities. A material such as described above may be easily compressed to less than one-half of its uncompressed thickness, noting in this regard FIG. 2.

The light baffle 7 as described hereinabove may be assembled together with the lamp assembly 3 and the display panel 5 and maintained in its compressed state in any one of several possible ways. For example, the display panel 5 may be attached, as by screws, to a suitable fixed structure (e.g., a metal chassis) and the lamp assembly 3 and the associated uncompressed baffle 7 tightened, as with screws, against the fixed structure to cause the baffle 7 to become compressed.

While there has been described what is considered a preferred embodiment of the invention, it will be obvious to those skilled in the art that various changes and modifications may be made therein without departing from the invention as called for in the appended claims.

What is claimed is:

1. A back-lighted display arrangement, comprising:
a light source support member supporting a plurality of light source means thereon;
display means including a plurality of display areas each of which is associated with a different one of the plurality of light source means and is arranged to be back-lighted by light emitted by the associated light source means; and
a light baffle of a compressible material compressively sandwiched between the light source support member and the display means for establishing a light seal between the baffle and the light source support member and display means, said compressed light baffle having portions defining a plurality of compartments each arranged to receive a different one of the plurality of light source means whereby light emitted by the light source means is directed onto the display area associated with the light source means.

2. A back-lighted display arrangement in accordance with claim 1 wherein:
the light baffle is of a soft, compressible material.

3. A back-lighted display arrangement in accordance with claim 1 wherein:
the light baffle is of a flexible, resilient, light-weight, electrically non-conductive material.

4. A back-lighted display arrangement in accordance with claim 3 wherein:
the light baffle is of a polyurethane cellular foam material.

5. A back-lighted display arrangement in accordance with claim 1 wherein:
the light source means are arranged on the light source assembly in a row and column format;
the compartments of the light baffle are in a row and column format; and
the display areas of the display means are arranged in a row and column format.

* * * * *